US005479772A

United States Patent [19]

Halila

[11] Patent Number: 5,479,772

[45] Date of Patent: Jan. 2, 1996

[54] FILM COOLING STARTER GEOMETRY FOR COMBUSTOR LINERS

[75] Inventor: Ely E. Halila, Cincinnati, Ohio

[73] Assignee: General Electric Company, Cincinnati, Ohio

[21] Appl. No.: 167,102

[22] Filed: Dec. 16, 1993

Related U.S. Application Data

[62] Division of Ser. No. 897,699, Jun. 12, 1992, abandoned.

[51] Int. Cl.[6] ..... F02C 7/32; F23R 3/08

[52] U.S. Cl. ..... 60/39.32; 60/747; 60/757

[58] Field of Search ..... 60/39.32, 39.37, 60/747, 752, 755, 756, 757

[56] References Cited

U.S. PATENT DOCUMENTS

| | | | |
|---|---|---|---|
| 2,610,467 | 9/1952 | Miller . | |
| 2,617,255 | 11/1952 | Neihus . | |
| 2,658,337 | 11/1953 | Clarke et al. . | |
| 2,670,601 | 3/1954 | Williams et al. . | |
| 2,930,193 | 3/1960 | Jaramillo . | |
| 3,408,812 | 11/1968 | Stenger . | |
| 3,420,058 | 1/1969 | Howald et al. . | |
| 3,793,827 | 2/1974 | Ekstedt . | |
| 3,854,285 | 12/1974 | Stenger et al. . | |
| 3,990,232 | 11/1976 | Campbell . | |
| 4,194,358 | 3/1980 | Stenger | 60/747 |
| 4,259,842 | 4/1981 | Koshoffer et al. . | |
| 4,304,523 | 12/1981 | Corsmeier et al. . | |
| 4,485,630 | 12/1984 | Kenworthy . | |
| 4,686,823 | 8/1987 | Coburn et al. | 60/39.32 |
| 4,773,227 | 9/1988 | Chabis . | |
| 4,896,510 | 1/1990 | Foltz . | |
| 5,012,645 | 5/1991 | Reynolds . | |
| 5,142,871 | 9/1992 | Lampes et al. . | |
| 5,197,278 | 3/1993 | Sabla et al. . | |
| 5,220,795 | 6/1993 | Dodds et al. . | |

FOREIGN PATENT DOCUMENTS

| | | |
|---|---|---|
| 492864A1 | 7/1992 | European Pat. Off. . |
| 697027 | 9/1953 | United Kingdom . |
| 1136543 | 12/1968 | United Kingdom . |

OTHER PUBLICATIONS

Patent Abstracts of Japan, vol. 9, No. 164 (M-395)(1887) Jul. 10, 1985, and JP-A-60 038 530 (Hitachi) Feb. 28, 1985 Abstract.

*Primary Examiner*—Timothy S. Thorpe
*Attorney, Agent, or Firm*—Andrew C. Hess; Patrick R. Scanlon

[57] ABSTRACT

A film starter structure for a combustor of a gas turbine engine which includes a plurality of circumferentially spaced, axially extending ribs formed on a radially inner surface of a forward section of an outer combustor liner adjacent a combustor dome. An annular ring overlays the ribs for defining a plurality of air passages. A support extends from the combustor dome and supports the outer liner about the dome. Compressor discharge air is introduced into the air passages and exits the air passages along the inner surface of the outer liner for establishing a cooling film barrier on the outer combustor liner surface. A spring seal between the combustor dome and the inner ring seats the dome within the ring and establishes a seal for preventing leakage air therebetween and allowing independent radial expansion of the liner and dome by compressing the spring seal. The liner and dome structure are further arranged to allow assembly using flanges and split rings so as to eliminate placement of bolted connections in critical air flow paths.

9 Claims, 8 Drawing Sheets

FILM COOLING STARTER GEOMETRY FOR COMBUSTOR LINERS

The government has rights in this invention pursuant to Contract No. F33615-88-C- 2826 awarded by the Department of the Air Force. This application is a division of application Ser. No. 07/897,699, filed 06/12/92, now abandoned.

BACKGROUND OF THE INVENTION

The present invention relates to combustors in gas turbine engines, and more particularly, to an improved combustor geometry for initiating an air film on a combustor liner of a gas turbine engine.

FIG. 1 is a simplified, partial cross-sectional illustration of a prior art dual annular combustor 10. Combustor 10 has an outer liner 12 and an inner liner 14. The outer liner 12 is connected to an outer dome 16 and the inner liner is connected to an inner dome 18. Outer liner 12 and inner liner 14 are provided with film cooling holes 20 which are drilled through the liners at an angle selected to establish a film of insulative cooling air over the inner surface of the liners. In one example, the holes 20 are angled at between about 20 to 30 degrees with respect to the liner surface and have a diameter of 20–40 mils. The film cooling holes 20 allow compressor discharge air indicated by arrows 22 to convectively cool the material surrounding the immediate area within the hole passageway. After the air exits from the hole, it further provides a barrier film protection 23 between the hot combustor gases in the interior of the combustion 10 and the liner surface 24 of both the inner and outer liners 14 and 12, respectively. This film is intended to prevent direct contact of the hot gases with the liner surface. FIG. 1A is an enlarged cross-sectional view of liner 12 more clearly showing the angled air holes 20 which provide the cooling air 22 for barrier film 23.

The dual annular combustor 10 of FIG. 1 extends circumferentially around an engine centerline (not shown) with a plurality of inner and outer swirlers 26 circumferentially spaced around the centerline. Swirlers 26 are alternatively referred to as carburetor devices. The film cooling holes 20 are situated in such a manner as to provide a cooling air film 23 extending both downstream and circumferentially around the outer liner 12 and inner liner 14.

In order to maintain the uniformity of surface contact of barrier film cooling 23, an air film starter is needed. Typically, an air film starter, shown in FIG. 2, which is an enlarged view of the axially forward, outer corner of the combustor assembly of FIG. 1, has been formed by the relational geometry of the extreme forward end 30 of the outer liner 12 to the outer dome 16. The relational geometry of the extreme forward region 31 of the inner liner 14 to the inner dome 18 forms a film starter for the inner liner 14.

In FIG. 2, outer dome 16 has a lip region 28 which is located immediately radially inward from a forward end 30 of the outer liner 12. Holes 33 drilled within the lip region 28 of the dome 16 act as a film starter within a channel 32 in that compressor discharge air 22 is channeled through the channel 32 and proceeds to flow aftward along the interior surface 24 of the outer liner 12.

To ensure cooling performance, without film deterioration, a constant height and constant flow area must be maintained within the channel 32. However, due to manufacturing tolerances, substantial enough differences exist between the various domes which make up the annular combustor 10 that a constant height within the channel 32 is not uniformly maintained. This lack of uniformity in height and flow area passageway reduces the air film effectiveness. In that a film starter creates a flow in the air film which continues to flow aftward as additional air is injected into the air film flow path by the film cooling holes 20, the effectiveness and flow of this air film 23 along surface 24 is reduced because the concentricity and height uniformity of lip region 28 is not maintained. This will result in the air film downstream deterioration by not allowing the formation and continued buildup of a uniform air film along surface 24.

In the prior art, stack-up/concentricity effects and non-uniform height and area variation effects cause the amount of film air flow to be non-uniform such that the critical flow rate in local areas will fall below the requirements necessary to maintain a continuous film and film cooling build-up. This problem particularly manifests itself in a reduction in the downstream film cooling. If this reduction is large enough, it can cause the local liner temperature and temperature gradients to increase significantly to such a degree that liner cracking will result, and cause engine teardown for replacement.

Another problem encountered in the prior art which has a detrimental effect upon air film cooling starter is how the outer liner and inner liner are secured to a combustor casing or an inner support member of the gas turbine engine. If bolts or other securing means obstruct the air which is to be used as a film starter, the downstream cooling effects of the air will be reduced.

Thus, a need is seen for a combustor having a geometry which maximizes the cooling effects of air film starter discharge.

SUMMARY OF THE INVENTION

The above and other disadvantages of the prior art are overcome in an improved film starter structure for a combustor of a gas turbine engine in accordance with the present invention. In an exemplary form, at least an axially forward section of each of an inner and outer combustor liner is formed from a ceramic matrix composite material which is hardened and machined to create a plurality of circumferentially spaced, axially extending ribs on an inner surface adjacent a combustor dome. An annular ring is bonded to the ribs so as to form a plurality of air passages extending along the liner surface. A first support extends from the dome for supporting the outer liner about the combustor dome. An air chamber is defined between the support and the outer liner for introducing compressor discharge air into the air passages so that the air is directed along the inner surface of the outer liner to initiate a film of barrier cooling air over the liner surface. A substantially similar arrangement is provided for the inner liner for starting a barrier of cooling air over the inner liner.

The illustrative embodiment also includes a spring seal between the combustor dome and the annular ring. The seal prevents compressor discharge air from leaking into the dome and also accommodate radial expansion growth differentials between the CMC liner and the metallic dome structure, without losing the sealing relationship. A plurality of holes extending from the air chamber through the support directs air adjacent the spring seal to prevent deterioration by encroachment of the hot combustor gases.

A split ring is positioned between the support and a flange on the outer combustor liner for axially retaining the outer liner within the dome structure. In one form, the split ring is formed with a plurality of circumferentially spaced ribs defining a plurality of slots which allow compressor discharge air to enter the air chamber. In another form, the ribs are machined on the outer liner flange and the split ring serves only as a retainer. In still another form, the split ring serves as a retainer and limited seal and holes are formed in the support for admitting compressor discharge air into the chamber.

While the inner liner is attached and the film starter structure generally identical to the outer liner structure, in other embodiments the inner dome support for the inner liner may include a radially extending annular segment and an axially extending annular segment. A combustor mount supports the axially forward end of the combustor and includes an annular member attached to a hub structure. The annular member has an axially forward end which includes a radially outward extending flange. A split ring reacts between the flange on the annular member and a flange on the inner liner for axially retaining the liner. The annular member is attached to the axially extending segment of the inner dome support.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings wherein.

DETAILED DESCRIPTION OF THE INVENTION

Figure 1:
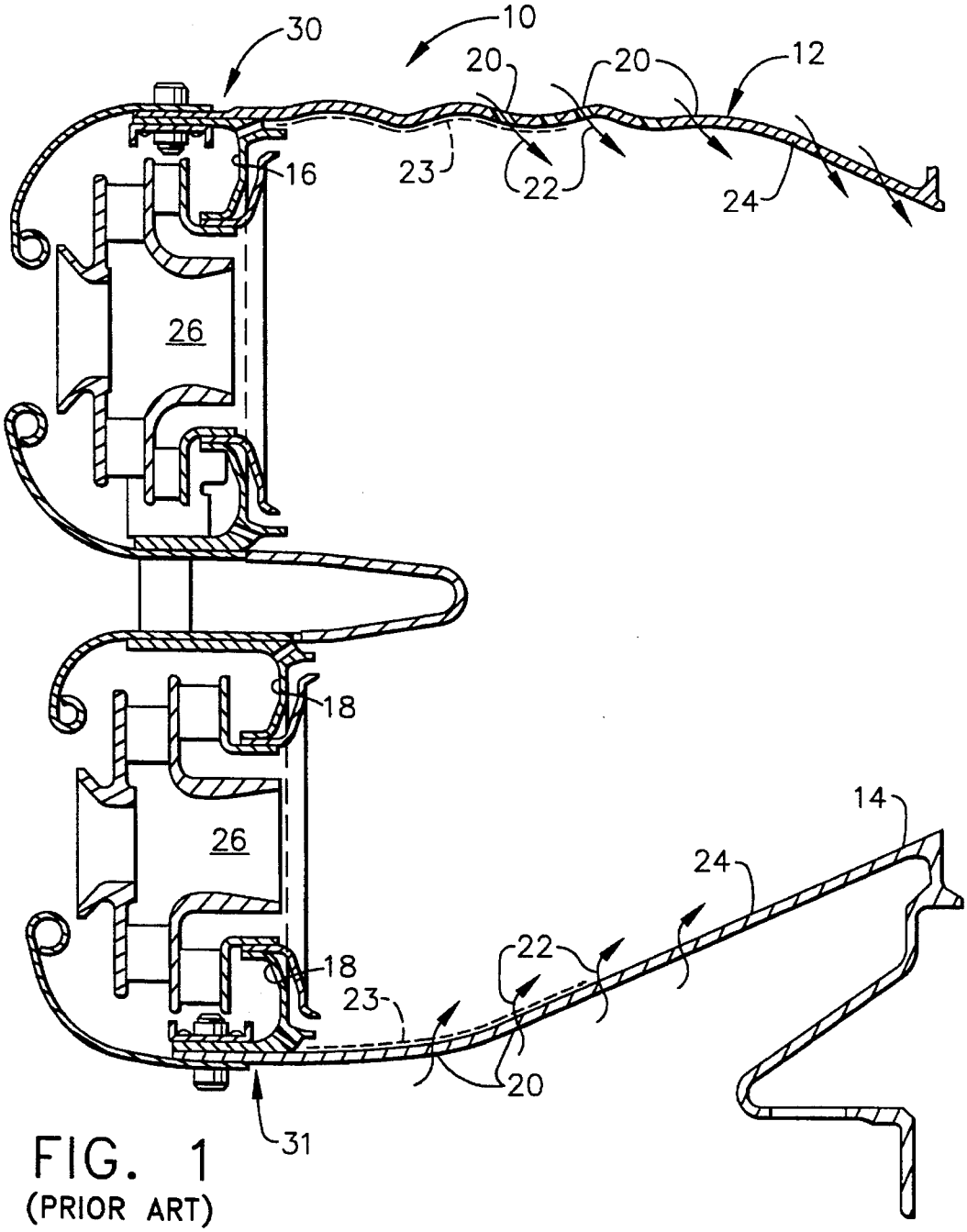
FIG. 1 (PRIOR ART)
FIG. 1 is a simplified, partial cross-sectional view of a dual annular combustor for a gas turbine engine.
Figure 1A:
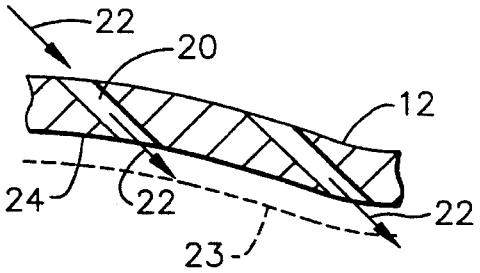
FIG. 1A is an enlarged sectional drawing of the combustor liner showing the air hole orientation.
Figure 2:
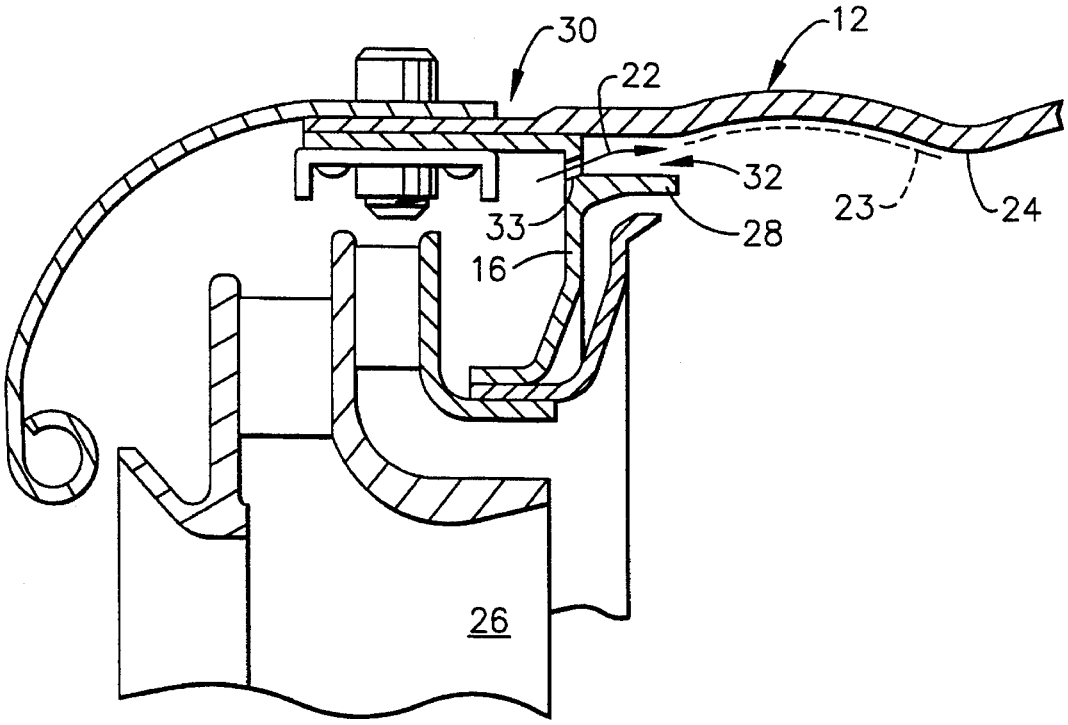
FIG. 2 (PRIOR ART)
FIG. 2 is an enlarged cross-sectional view of the dome to liner coupling and film starter geometry of the combustor of FIG. 1.
Figure 3:
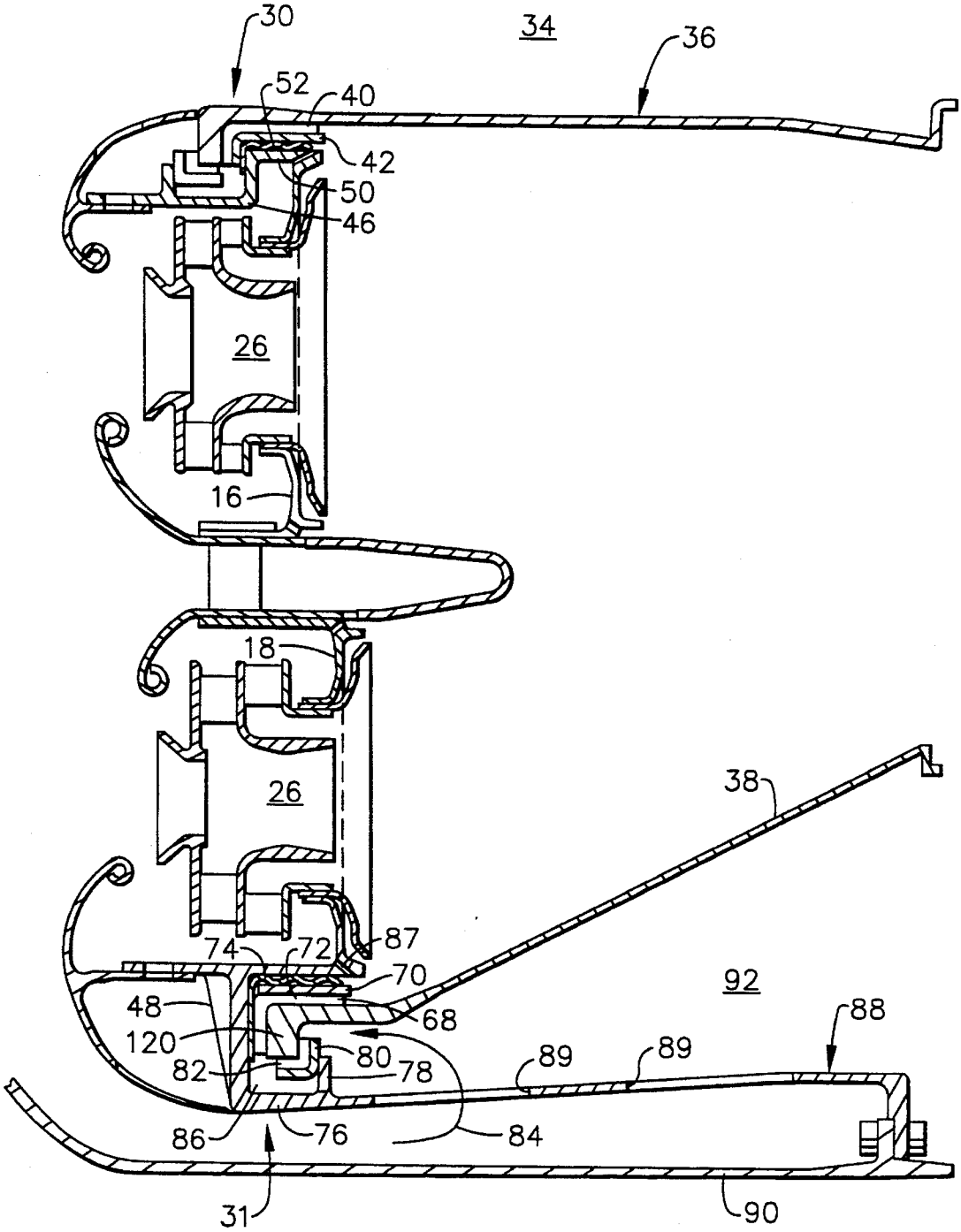
FIG. 3 is a cross-sectional view of a combustor in accordance with the present invention.

Referring to FIG. 3, there is shown a cross-sectional view, similar to FIG. 1, of a dual annular combustor 34 in accordance with one form of the present invention. Combustor 34 has an outer liner 36 and an inner liner 38 in which their respective forward sections 30 and 31 are formed in a manner to provide a uniform film starter. In particular, outer liner forward section 30 is formed with a plurality of circumferentially spaced, radially inner ribs 40. The ribs 40 are preferably integral with the outer liner forward section 30. In a preferred embodiment, the liner section 30 is formed of a ceramic matrix composite (CMC) material but may be metallic or intermetallic material. CMC material is known in the art and allows the liner section 30 to be formed by matrix fiber lay-up on a mandrel or other form. The CMC material is then treated by chemical vapor infiltration (CVI) which makes the material sufficiently hardened to be machined. The ribs 40 are then machined by grinding or other means to the illustrative configuration. An inner annular ring 42 having a generally L-shaped cross-section conforming to the shape of the inner ribs 40 and formed from the same CMC material is thereafter bonded to the ribs 40 such that a plurality of circumferentially spaced air passages 44 (see FIG. 4B) are defined between the ribs 40, the liner section 30 and the inner ring 42*a*. The bonding process for the ribs 40 of outer liner forward section 30 to inner ring 42 also utilizes CVI with these two parts being held in assembled position such that the inner ring 42 is integrally bonded to the ribs 40.

As described earlier with respect to FIG. 1, the dual annular combustor of FIG. 3 includes a double row of carburetor devices or swirlers 26 for mixing air and fuel for combustion within the combustor. The carburetor devices 26 are mounted in respective outer and inner domes 16 and 18. The same basic carburetor dome structure of FIG. 1 is shown in FIG. 3 but with modification of each dome structure. In the inventive dome structure of FIG. 3, the outer dome 16 includes an annular support 46 and the inner dome 18 includes an annular support 48. The support 46 has a first section 50 generally concentric with inner ring 42 which captures a spring seal 52 between ring 42 and support 46, which seal prevents air leakage between dome 16 and inner 42 into combustion chamber 34 and also provides concentricity between liner 36 and dome section 50. Seal 52 also accommodates radial expansion of the liner 42 and domes 16 without losing the sealing or concentricity relationships.

Figure 4:
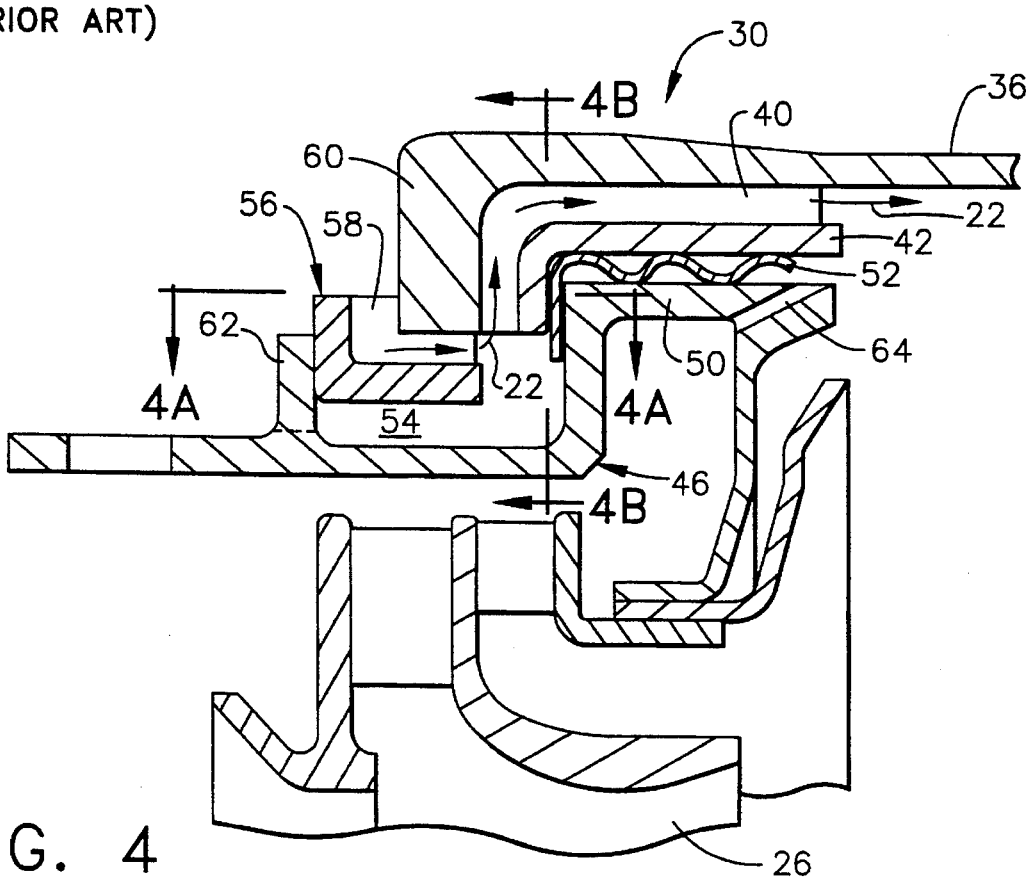
FIG. 4 is an enlarged cross-sectional view corresponding to FIG. 2 but of the inventive combustor of FIG. 3.

Considering FIG. 4 in conjunction with FIG. 3, an annular chamber 54 is defined between support 46 and the axially forward end 60 of outer liner section 30. Compressor discharge air is supplied to chamber 54 through a split ring 56 having a plurality of circumferentially spaced ribs 58 which engage the axially forward end 60 of liner section 30. Split ring 56 is restrained axially by a circumferential flange 62 extending radially from support 46 and by contact with end 60 of liner section 30. The split ring 56 has a generally L-shaped cross-section which allows it to be captured in the illustrated arrangement. The ring 56 is assembled in position by compressing it below the height of flange 62 prior to sliding the combustor liner into the dome structure.

In the assembled condition of the inventive structure, air flows through passages or bleed holes 64 between the ribs 58 (See FIG. 4A) and into chamber 54. From chamber 54, the compressor discharge air flows out through air passages 44 between ribs 40 (See FIG. 4B). The air from passages 44, indicated by arrows 22 in FIG. 4, initiates or starts a cooling air film along the inner surface of outer liner 36. Because the manufacturing of the ribs 40 and inner liner 42 allows for better control of tolerances, the structure of FIG. 3 avoids the disadvantages discussed with regard to FIG. 1. It is also to be noted that the structure of FIG. 3 eliminates the bolts in the air flow path to passages 44 and thus avoids the air flow turbulence problems of the prior art. The dome 16 includes circumferentially spaced bleed holes 64 which are so angled as to direct a flow of air towards the inner surface of outer liner 36 adjacent an end of spring seal 52 for minimizing the encroachment of the hot combustion gases onto the seal 52.

Figure 5:
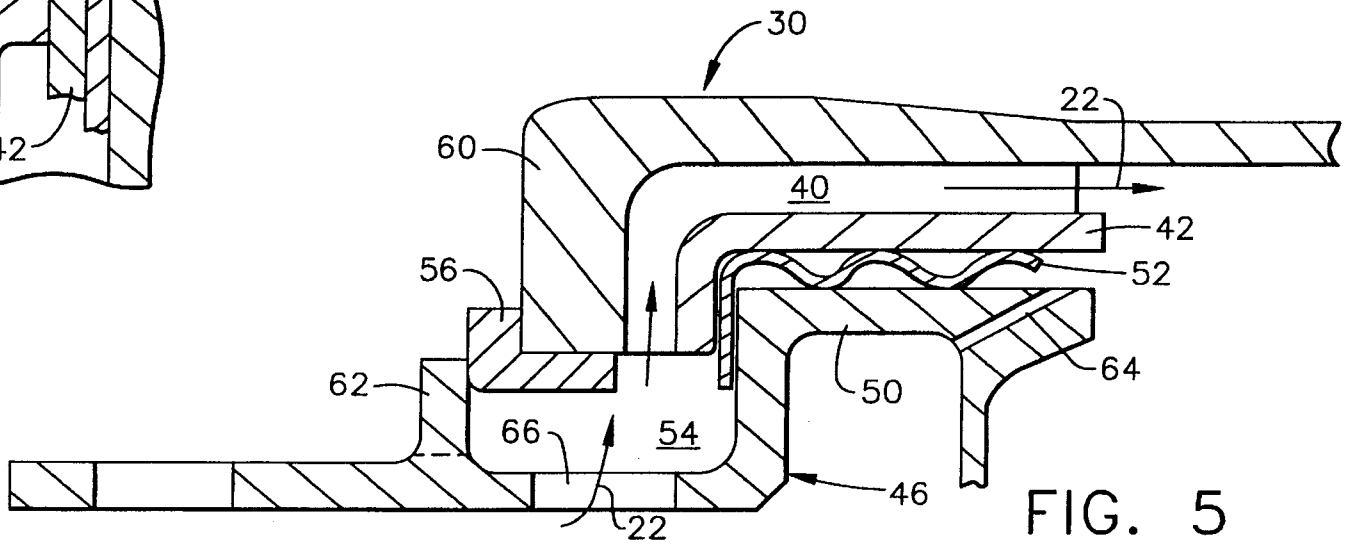
FIG. 5 is a cross-sectional view corresponding to FIG. 4 of an alternate embodiment of the present invention.
Figure 5A:
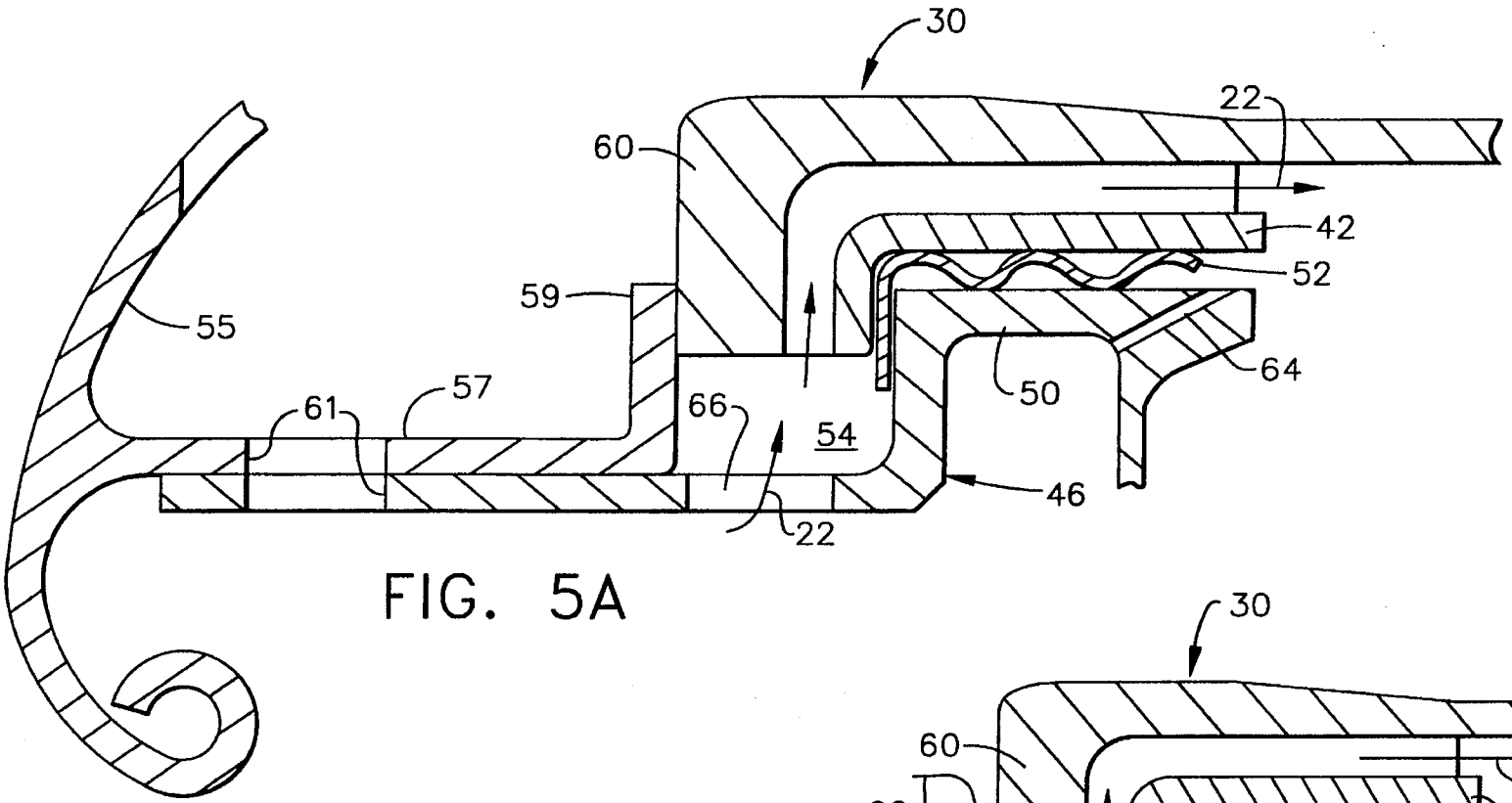
FIG. 5A is similar to FIG. 5 illustrating still another embodiment of the invention.

Before discussing the inner liner structure, reference is made to FIG. 5 which shows an alternate embodiment of the structure of FIG. 4. In particular, the split ring 56 is formed without the ribs 58 so that the ring 56 now acts only for liner retention. In this embodiment, air flows through circumferentially spaced apertures 66 in dome support 46 and into chamber 54. FIG. 5A illustrates an alternate liner retention arrangement in which the split ring 56 and flange 62 have been eliminated. In this embodiment a cowl 55, which is attached to dome support 46 via an axially extending annular cowl flange 57, includes a radially outward extending flange 59 constructed to abut end 60 of liner 12 when the combustor is assembled. The flange 59 thus replaces the split ring 56 and flange 62. The cowl 55 is attached to support 46 by bolts (not shown) passing through aligned holes 61 in the cowl flange 57 and dome support 46.

Figure 4B:
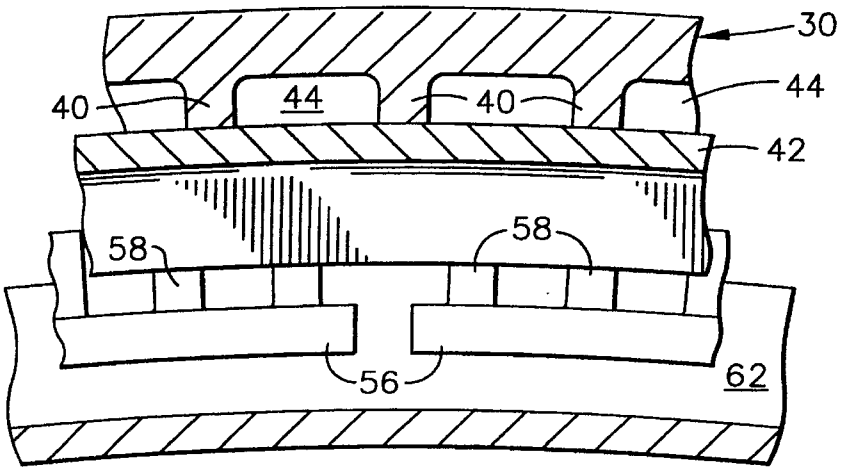
FIGS. 4A and 4B are views taken along lines 4A—4A and 4B—4B, respectively, in FIG. 4.
Figure 4A:
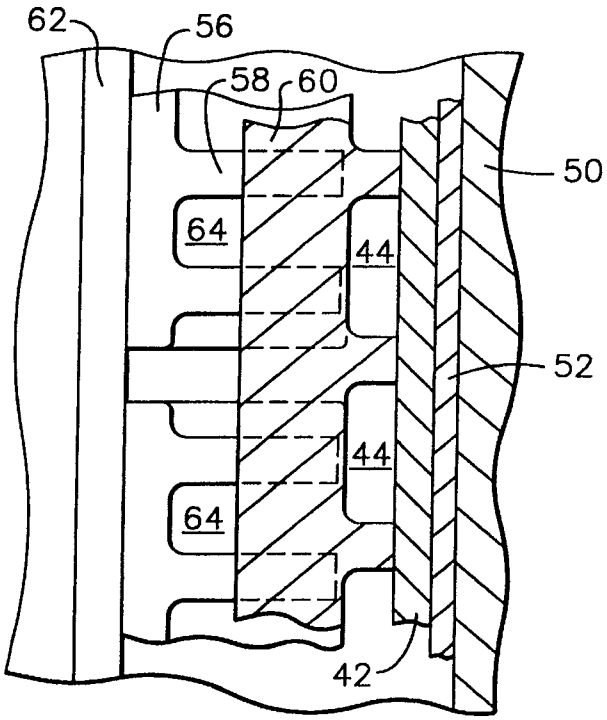
Figure 6:
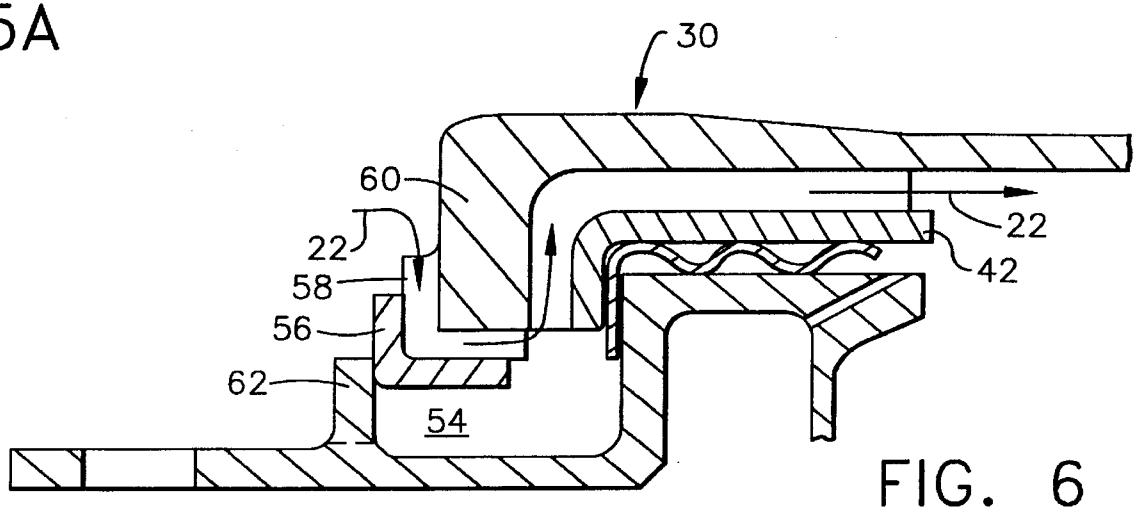
FIG. 6 is a cross-sectional view corresponding to FIG. 4 of still another embodiment of the present invention.

FIG. 6 is another embodiment of the invention of FIG. 3 in which the ribs 58 are now integrally formed with the liner section 30. Since liner section 30 is machined with the ribs 40, as seen in FIG. 4B, it is believed that the ribs 58 can be similarly machined, thus avoiding the need to form a ring with integral ribs. In this embodiment, the split ring 56 is similar to that of FIG. 5 and the operation of the system is the same as with the system of FIG. 3.

Referring again to FIG. 3, the inner liner film starter structure may be generally the same as the outer liner structure in that the axially forward end of the inner liner forward section 31 includes radially inward extending flange 120 and is processed with a plurality of circumferentially spaced ribs 68 (corresponding to ribs 40). An inner ring 70 is bonded to the ribs 68 so that air flow passages 72 are defined between the ribs 68. A spring seal 74 is positioned between ring 70 and dome 18. The dome 18 includes an annular support 76 which extends radially inward and axially aft to form a capture mechanism for inner liner forward section 31 of inner liner 38. Support 76 includes a radially extending flange 78 (corresponding to flange 62 of FIG. 4) which captures a split ring 80 against an end of liner section 31. The ring 80 includes spaced ribs 82 so that air passages are defined through the ring. High pressure compressor air, indicated by arrow 84, flows through ring 80 and into an annular chamber 86 and then outward between ribs 68 and along the radially outer surface of liner 38. Angled, circumferentially spaced holes 87 correspond to holes 64 of FIG. 4 and provide air flow to protect spring seal 74.

Figure 7:
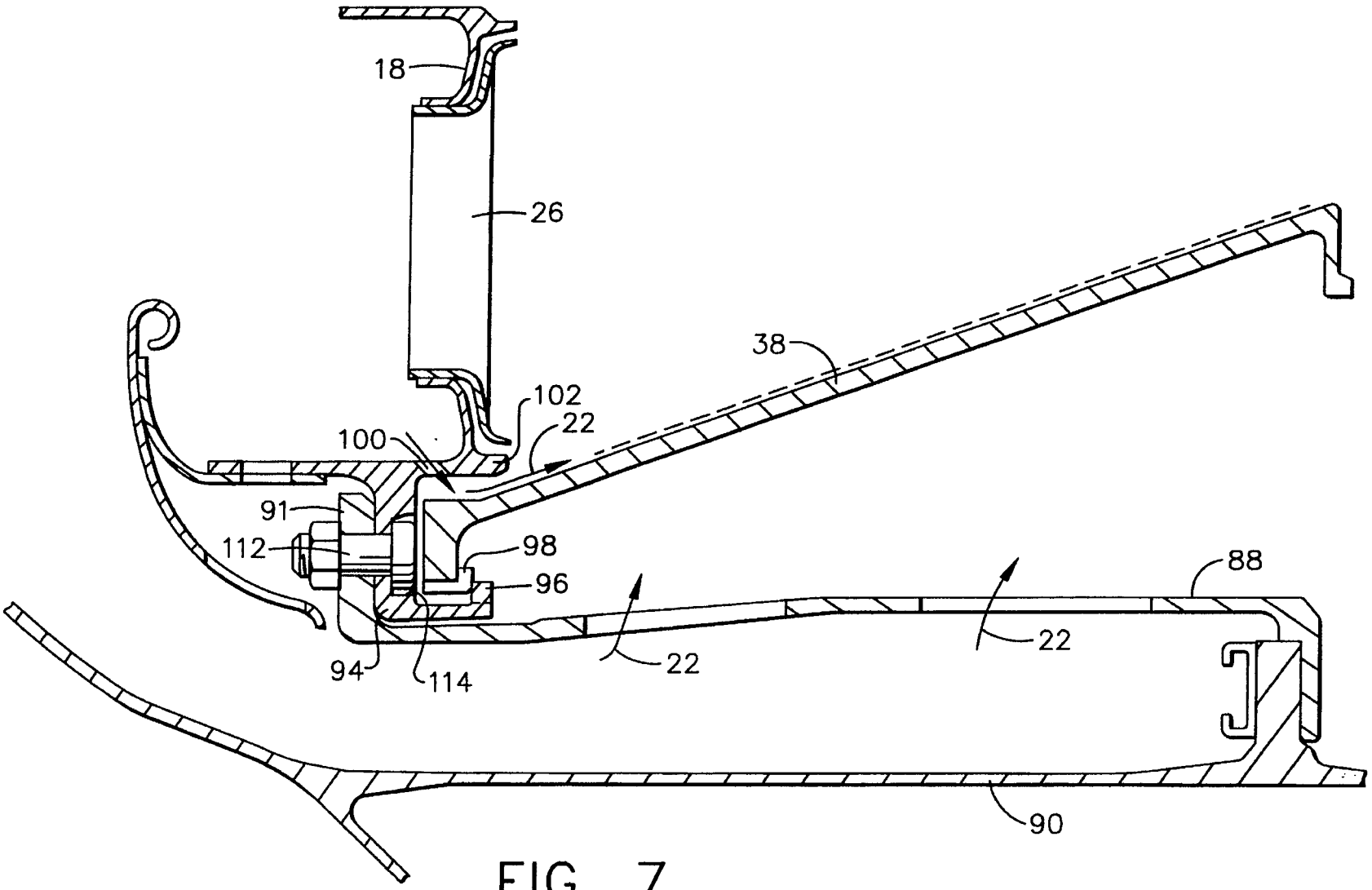
FIG. 7 is a cross-sectional view of a mounting and film starter geometry for an inner liner of the combustor of FIG. 8.

In the embodiment of FIG. 3, the support 76 is attached to a combustor mounting structure 88 by welding and the structure 88 is attached to a hub support structure 90. The mounting structure 88 is an annular member having a plurality of large holes 89 for admitting air into a pressurized cavity 92 between structure 88 and inner liner 38. In FIG. 7, an alternate embodiment of the inner liner attachment structure shows mounting structure 88 being formed with an integral radially extending flange 91 which is bolted to an L-shaped flange 94 extending from dome 18. The flange 94 also includes a radial flange 96, corresponding to flange 78 of FIG. 3, which captures a split ring 98. The ring 98 has an L-shaped cross-section adapted to clamp inner liner 38 against support flanges 94 and 96. In this embodiment, film starter air enters through angled holes 100 in dome 18 and is directed against liner 38. The dome 18 includes an axially aft extending annular flange 102 which assists in directing cooling air along the surface of liner 38. Note that the bolted connected between dome flange 94 and support structure flange 92 allows the bolt 112 head to be recessed into recess 114 of flange 94 and a torque to be applied from the front of the combustor. The recessed bolt heal also does not interfere with the CMC inner liner 38.

Figure 8:
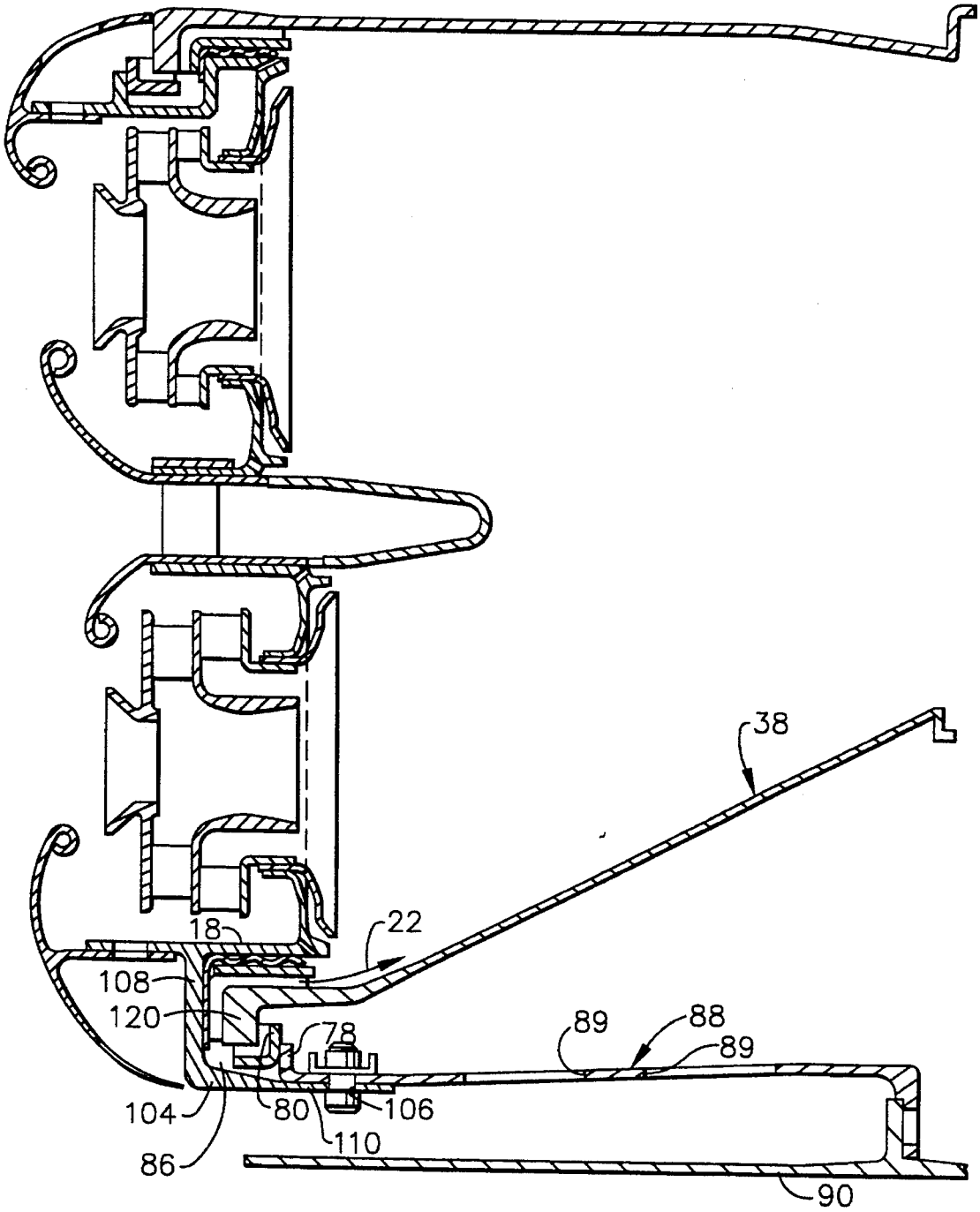
FIG. 8 is a cross-sectional view of a combustor in accordance with another embodiment of the present invention.
Figure 8A:
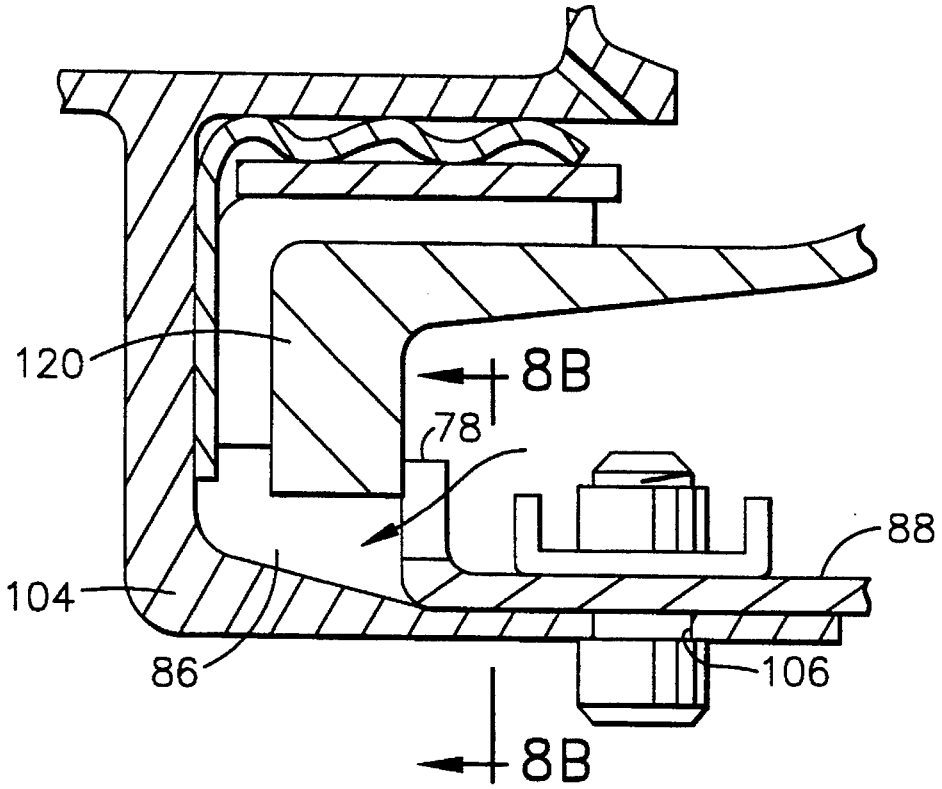
FIGS. 8A and 8B are radial and axial views of an alternate mounting arrangement for the inner combustor liner.
Figure 8B:
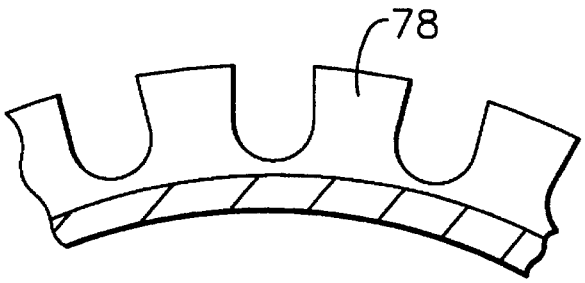

Still another form of the invention is shown in FIG. 8 in which the structure is similar to that of FIG. 3, but in which the inner dome 18 includes an L-shaped support 104 including radially extending segment 108 and axially extending segment 110 which overlaps an end of mounting support 88. The support 88 is formed such that the radially extending flange 78 is integral with support 88 rather than dome support flange 94. The support 88 and support 104 is bolted or otherwise joined along the overlapping portion at 106. A modification of the support structure of FIG. 8 is shown in FIG. 8A and 8B. In this modification, the support 88 is extended axially so that flange 78 can abut against the end of liner flange 120 (FIG. 3). This modification eliminates the need for split ring 80. In order to allow compressor discharge air to enter into chamber 86, the flange 78 is scalloped or castellated as shown in FIG. 8B taken along lines 8B—8B in FIG. 8A.

In general, it is desired to provide boltless retention in the areas where bolts or other protrusions are likely to interfere with air flow. While boltless retention is well known, the present invention has addressed those areas of the prior art which have not heretofore been susceptible to boltless retention. In particular, the present invention provides specific arrangements for minimizing air flow impedance in the areas where a smooth air flow is necessary in order to initiate a cooling air film.

As previously mentioned, the liners 36, 38 may be formed of a ceramic matrix composite (CMC) material. If such CMC material is used in the practice of the invention, it may be desirable to apply a compliant layer between surfaces of the liners and any mating metal components, such as the split ring retainer 56, in a manner well known in the art. The CMC material is typically a fiber reinforced fabricated material and can be machined after hardening using chemical vapor infiltration processing. In its hardened form, the CMC material is harder than the metal alloys forming other portions of the combustor. The compliant layer is thus placed along any rubbing interface between CMC material and other metal parts. An exemplary compliant material is available from Brunswick Technetics, Inc. under their mark BRUNSBOND.

While the invention has been described in what is considered to be a best mode, various modifications will become apparent to those of ordinary skill in the art. It is intended, therefore, that the invention not be limited to the illustrative embodiments but be interpreted within the full spirit and scope of the appended claims.

What is claimed is:

1. An improved film starter structure for a combustor of a gas turbine engine, the combustor having an outer annular liner and an inner annular liner, an axially forward section of each of the inner and outer liners being coupled to a combustor dome, high pressure compressor air being directed onto the combustor dome and the liners for mixing with fuel for combustion and for cooling the surfaces of the liners by establishing a uniform insulative film of cooling air on the internal liner surfaces, the structure comprising:

a plurality of circumferentially spaced, axially extending ribs formed on a radially outer surface of the forward section of the inner liner generally adjacent the combustor dome, said ribs defining a plurality of spaced slots;

an annular inner ring overlying said ribs and slots of the inner liner for defining a plurality of air passages;

a support extending from the combustor dome for supporting the inner liner to the dome;

means for defining an air chamber for introducing compressor discharge air into said air passages, the compressor discharge air exiting said air passages along the radially outer surface of the inner liner for establishing a cooling film barrier on the combustor liner surface; and a spring seal disposed between the combustor dome and said annular ring for urging said annular ring against said ribs.

2. The structure of claim 1, further comprising a plurality of circumferentially spaced apertures extending through the combustor dome adjacent said support, said apertures being angularly oriented for directing a flow of compressor air towards the inner liner generally adjacent an axially aft end of said ribs.

3. The structure of claim 1, further comprising an annular split ring circumscribing the combustor adjacent an axially forward end of the axially forward section of the inner liner, said split ring being captured between a forward end of the inner liner and said support for restraining the dome with respect to the inner liner.

4. The structure of claim 1, wherein said support includes a radially outward extending annular flange and said axially forward end of the inner liner comprises a radially inward extending annular flange, and including a split ring, said split ring reacting between said flanges to inhibit axial movement therebetween and said split ring reacting against an end of said liner flange for radially retaining said split ring.

5. The structure of claim 1, wherein said support comprises a first radially extending annular segment and a second axially extending annular segment, the structure further including a combustor mounting means for supporting the axial forward end of the combustor, said mounting means including an annular member attached to a hub structure, said annular member having an axially forward end including a radially outward extending annular flange, and further including a split ring reacting between said flange on said annular member and a flange on the inner liner, said annular member being attached to said support along said axially extending segment.

6. The structure of claim 5, further comprising a plurality of apertures extending through said annular member for supplying compressor discharge air to said inner liner.

7. The structure of claim 1, further comprising a combustor mounting structure for supporting the axial forward end of the combustor, said mounting structure having an axially forward end with a radially outward extending annular flange, said mounting structure flange abutting a flange on said liner for supporting said liner to the combustor dome.

8. The structure of claim 7, wherein said mounting structure flange is scalloped to permit compressor discharge air into said air chamber.

9. An improved film starter structure for a combustor of a gas turbine engine, the combustor having an outer annular liner and an inner annular liner, an axially forward section of each of the inner and outer liners being coupled to a combustor dome, high pressure compressor air being directed onto the combustor dome and the liners for mixing with fuel for combustion and for cooling the surfaces of the liners by establishing a uniform insulative film of cooling air on the internal liner surfaces, the structure comprising:

a first plurality of circumferentially spaced, axially extending ribs formed on a radially inner surface of the forward section of the outer liner generally adjacent the combustor dome, said ribs defining a first plurality of spaced slots;

a first annular inner ring overlaying said first plurality of ribs and said first plurality of slots for defining a first plurality of air passages between said ribs and said ring;

a first support extending from the combustor dome for supporting the outer liner to the dome;

means for defining a first air chamber for introducing the compressor discharge air into said first plurality of air passages, the compressor discharge air exiting said first plurality of air passages along the inner surface of the outer liner for establishing a cooling film barrier on the outer combustor liner surface;

a second plurality of circumferentially spaced, axially extending ribs formed on a radially outer surface of the forward section of the inner liner generally adjacent the combustor dome, said second plurality of ribs defining a second plurality of spaced slots;

a second annular inner ring overlaying said second plurality of ribs and second plurality of slots of the inner liner for defining a second plurality of air passages;

a second support extending from the combustor dome for supporting the inner liner to the dome;

means for defining a second air chamber for introducing the compressor discharge air into said second plurality of air passages, the compressor discharge air exiting said second plurality of air passages along the radially outer surface of the inner liner for establishing a cooling film barrier on the combustor liner surface; and a spring seal disposed between the combustor dome and said second annular ring for urging said second annular ring against said second plurality of ribs.

* * * * *